US011166562B2

(12) United States Patent
Zhang et al.

(10) Patent No.: US 11,166,562 B2
(45) Date of Patent: Nov. 9, 2021

(54) FOOTREST DRIVING APPARATUS AND LIFT CHAIR THEREWITH

(71) Applicant: Changzhou Zehui Machinery Co., Ltd, Jiangsu (CN)

(72) Inventors: Zhixing Zhang, Jiangsu (CN); Liming Zhu, Jiangsu (CN)

(73) Assignee: Changzhou Zehui Machinery Co., Ltd, Changzhou (CN)

( * ) Notice: Subject to any disclaimer, the term of this patent is extended or adjusted under 35 U.S.C. 154(b) by 0 days.

(21) Appl. No.: 16/993,576

(22) Filed: Aug. 14, 2020

(65) Prior Publication Data

US 2021/0219727 A1 Jul. 22, 2021

(30) Foreign Application Priority Data

Jan. 18, 2020 (CN) ..... 202010055958.6
Jan. 18, 2020 (CN) ..... 202020114210.4

(51) Int. Cl.

| | |
|---|---|
| ***A47C 1/035*** | (2006.01) |
| ***A61G 5/14*** | (2006.01) |
| ***A47C 7/50*** | (2006.01) |
| ***A47C 1/0355*** | (2013.01) |
| ***A47C 3/20*** | (2006.01) |
| *A47C 1/032* | (2006.01) |

(52) U.S. Cl.

CPC ..... *A47C 7/5068* (2018.08); *A47C 1/0355* (2013.01); *A47C 3/20* (2013.01); *A47C 1/03211* (2013.01)

(58) Field of Classification Search

CPC ..... A47C 1/0355; A47C 3/20; A61G 5/14

USPC ..... 297/68–87, 330, DIG. 10

See application file for complete search history.

(56) References Cited

U.S. PATENT DOCUMENTS

| | | | | |
|---|---|---|---|---|
| 3,582,135 A * | 6/1971 | Fletcher | A47C 1/0355 297/83 X |
| 3,743,348 A * | 7/1973 | Sloan | A47C 1/0355 297/85 M X |
| 4,071,275 A * | 1/1978 | Rogers, Jr. | A47C 1/0355 297/85 L X |
| 4,108,491 A * | 8/1978 | Rogers, Jr. | A47C 1/0355 297/85 L X |

(Continued)

FOREIGN PATENT DOCUMENTS

CN 102160717 B 11/2015

*Primary Examiner* — Rodney B White

(74) *Attorney, Agent, or Firm* — Locke Lord LLP; Tim Tingkang Xia, Esq.

(57) ABSTRACT

A footrest driving apparatus includes a seat frame (2), a footrest member (4), a driving mechanism (3) and a footrest linkage mechanism (5) connected to the seat frame (2), the driving mechanism (3) and the footrest member (4). The seat frame (2) has two mounting boards (21), and each mounting board (21) has a curved guide slot (22). The driving mechanism (3) has two driving arms (32). Each driving arm (32) has a guide rod (33) matching with a corresponding curved guide slot (22), and a pin (34) rotatably connected with the corresponding mounting board (21). The guide rod (33) of each driving arm (32) correspondingly moves between a first position and a second position in the curved guide slot, allowing the driving mechanism (3) to drive the footrest linkage mechanism (5) to move the footrest member (4) between a stowed position and a reclined position.

14 Claims, 6 Drawing Sheets

(56) References Cited

U.S. PATENT DOCUMENTS 4,185,869 A * 1/1980 Rogers, Jr. ..... A47C 1/0355 297/84 X
4,185,870 A * 1/1980 Johnson ..... A47C 1/035 297/84 X
4,226,468 A * 10/1980 Johnson ..... A47C 1/0347 297/83 X
4,247,146 A * 1/1981 Cycowicz ..... A47C 1/0347 297/317
4,291,913 A * 9/1981 Kowalski ..... A47C 1/0345 297/68 X
4,337,977 A * 7/1982 Rogers, Jr. ..... A47C 1/0355 297/85 L X
4,350,387 A * 9/1982 Rogers, Jr. ..... A47C 1/0355 297/85 R X
4,357,049 A * 11/1982 Rogers, Jr. ..... A47C 1/0355 297/85 R X
4,418,957 A * 12/1983 Rogers, Jr. ..... A47C 1/0355 297/85 R X
4,544,201 A * 10/1985 Rogers, Jr. ..... A47C 3/0255 297/84 X
4,601,513 A * 7/1986 Pine ..... A47C 3/03 297/85 L X
4,707,025 A * 11/1987 Rogers, Jr. ..... A47C 3/027 297/85 L X
4,815,788 A * 3/1989 May ..... A47C 1/0355 297/85 L X
4,878,710 A * 11/1989 Tacker ..... A47C 1/0355 297/85 L X
4,904,019 A * 2/1990 May ..... A47C 1/0355 297/68 X
4,946,222 A * 8/1990 Matson ..... A61G 5/14 297/330 X
4,989,914 A * 2/1991 Pine ..... A47C 1/0352 297/85 L X
5,072,988 A * 12/1991 Plunk ..... A47C 1/0355 297/68 X
5,312,153 A * 5/1994 Lin ..... A47C 1/0345 297/DIG. 10 X
5,360,255 A * 11/1994 Cook ..... A47C 1/0355 297/68 X
5,975,627 A * 11/1999 LaPointe ..... A47C 1/0355 297/83 X
6,000,758 A * 12/1999 Schaffner ..... A47C 1/0345 297/83 X
6,409,262 B1 * 6/2002 LaPointe ..... A47C 1/0352 297/83 X
6,659,556 B2 * 12/2003 Pellerin ..... A61G 5/14 297/330
7,673,933 B2 3/2010 Lawson
7,766,421 B2 8/2010 Lawson
7,850,232 B2 * 12/2010 Casteel ..... A47C 1/0352 297/85 L
8,915,544 B2 * 12/2014 LaPointe ..... A61G 5/14 297/85 M
9,603,453 B2 * 3/2017 Hoffman ..... A47C 1/0355
2003/0015893 A1 * 1/2003 Hoffman ..... G06F 17/142 297/85 R
2008/0150329 A1 6/2008 Lawson
2008/0290710 A1 11/2008 Lawson

* cited by examiner

FOOTREST DRIVING APPARATUS AND LIFT CHAIR THEREWITH

CROSS-REFERENCE TO RELATED PATENT APPLICATIONS

This non-provisional application claims priority to and the benefit of, pursuant to 35 U.S.C. § 119(a), patent application Serial Nos. CN202020114210.4 and CN202010055958.6, both filed in China on Jan. 18, 2020. The disclosure of the above applications is incorporated herein in their entireties by reference.

FIELD

The present invention generally relates to a lift chair, and particularly to a footrest driving apparatus and a lift chair therewith.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

FIGS. 1 and 2 shows a conventional lift chair, which may be implemented as an electronic sofa. As shown in FIGS. 1 and 2, the conventional lift chair includes a base frame 91, a seat frame 10, a driving mechanism 90, a footrest member 95, a linkage mechanism including a first linkage bar 92, a second linkage bar 93, and a third linkage bar 94, and a spring 98. The seat frame 10 is connected to the base frame 91 through a pair of linkages, and may be movable relative to the base frame. The driving mechanism 90 is mounted on the seat frame 10, and is connected to the first linkage bar 92. The first linkage bar 92 is connected to the second linkage bar 93. The second linkage bar 93 is connected to the third linkage bar 94, and a middle portion of the second linkage bar 93 is rotatably connected to the seat frame 10. The third linkage bar 94 is connected to the footrest member 95. The footrest member 95 is mounted in front of the seat frame 10. When the driving mechanism 90 rotates, the footrest member 95 is driven by the linkage mechanism including the first linkage bar 92, the second linkage bar 93 and the third linkage bar 94 to move between a stowed position and a reclined position.

However, in the conventional lift chair, the spring 98 is provided between the back side of the seat frame 10 and the second linkage bar 93 to provide a backward force to the footrest member 95, such that the driving mechanism 90 may easily move the footrest member 95 from the reclined position back to the stowed position. The backward force is an elastic force generated by the spring 98. If the elastic force of the spring 98 is excessive, the spring 98 may cause an inertial movement when the footrest member 95 moves from the stowed position to the reclined position, which causes the footrest member 95 not to move smoothly, thus causing the user on the lift chair to feel uncomfortable. Further, with the constantly repetitive operations of the lift chair, the spring 98 may lose its elasticity due to fatigue, such that the footrest member 95 may not be able to completely move back to the stowed position. Moreover, the footrest member 95 are connected to the driving mechanism 90 through the three linkage bars 92, 93 and 94, which firstly extend backward to the back side of the seat frame 10 and then extend forward to the driving mechanism 90 located at the front side of the seat frame 10. Thus, the overall length of the transmission path of the force sustained by the footrest member 95 to the driving mechanism 90 is excessive, and the mounting gaps between the linkage bars may accumulate, thus reducing the supporting force for the footrest member 95 in the reclined position. Finally, in the conventional lift chair, the quantity of the components forming the seat frame 10 is excessive, which causes the overall weight of the lift chair to remain high.

Therefore, a heretofore unaddressed need exists in the art to address the aforementioned deficiencies and inadequacies.

SUMMARY

The present invention, in one aspect, relates to a footrest driving apparatus used in a lift chair.

In one embodiment, the footrest driving apparatus includes: a seat frame (2), having two mounting boards (21) disposed at two lateral sides thereof, wherein the two mounting boards (21) are fixed to each other, and each of the two mounting boards (21) has a curved guide slot (22) formed thereon; a footrest member (4), disposed at a front side of the seat frame (2) and configured to move between a stowed position and a reclined position relative to the seat frame (2); a driving mechanism (3), comprising a driving bar (31), and two driving arms (32) disposed at two lateral sides of the driving bar (31) and one-to-one corresponding to the two mounting boards (21), wherein each of the driving arms (32) has a guide rod (33) and a pin (34), the guide rod (33) matches with the curved guide slot (22) of a corresponding one of the two mounting boards (21), and the pin (34) is rotatably connected with the corresponding one of the two mounting boards (21); and a footrest linkage mechanism (5), connected to the seat frame (2), the driving mechanism (3) and the footrest member (4); wherein the driving bar (31) is configured to drive the guide rod (33) of each of the two driving arms (32) to correspondingly move between a first position and a second position in the curved guide slot (22) of the corresponding one of the two mounting boards (21). When the guide rod (33) of each of the two driving arms (32) moves to the first position in the curved guide slot (22) of the corresponding one of the two mounting boards (21), the driving mechanism (3) drives the footrest linkage mechanism (5) to move the footrest member (4) to the stowed position, and when the guide rod (33) of each of the two driving arms (32) moves to the second position in the curved guide slot (22) of the corresponding one of the two mounting boards (21), the driving mechanism (3) drives the footrest linkage mechanism (5) to move the footrest member (4) to the reclined position.

In one embodiment, the footrest linkage mechanism (5) includes: a first linkage member (51) fixed to the two driving arms (32), wherein the first linkage member (51) has a first end fixed to the guide rods (33) of the two driving arms (32), a second end, and a middle portion located therebetween and fixed to the pins (34) of the two driving arms (32); a second linkage member (52) having a first end rotatably connected to the second end of the first linkage member (51), a second end, and a middle portion located therebetween; a third linkage member (53) having a first end rotatably connected to the second end of the second linkage member (52), and a second end rotatably connected to the seat frame (2); and a fourth linkage member (54) having a first end rotatably connected to the footrest member (4), and a second end rotatably connected to the middle portion of the second linkage member (52).

In one embodiment, the seat frame (2) further includes a first reinforcing member (23) disposed between the two mounting board (21) to connect and fix the two mounting board (21).

In one embodiment, the lift chair has a base frame (1) having two linkage seats (7) disposed at two lateral sides thereof and one-to-one corresponding to the two mounting boards (21), each of the two linkage seats (7) is connected to a corresponding one of the two mounting boards (21) by two linkage members, allowing the seat frame (2) to move vertically between an upper position and a bottom position relative to the base frame (1) through rotation of the two linkage members.

In one embodiment, the seat frame (2) further includes a second reinforcing member (24) located behind and in parallel to the first reinforcing member (23), and when the seat frame (2) is located at the bottom position, the second reinforcing member (24) is in contact with the two linkage seats (7).

In one embodiment, the footrest member (4) has a footrest extension member (81) located at a front side thereof to support ankles of a user.

In another aspect, the present invention relates to a lift chair. In one embodiment, the lift chair includes a base frame (1) having two linkage seats (7) disposed at two lateral sides thereof; and a footrest driving apparatus, comprising: a seat frame (2), disposed above the base frame (1), having two mounting boards (21) disposed at two lateral sides thereof and one-to-one corresponding to the two linkage seats (7), wherein the seat frame (2) is configured to move vertically between an upper position and a bottom position relative to the base frame (1), the two mounting boards (21) are fixed to each other, and each of the two mounting boards (21) has a curved guide slot (22) formed thereon; a footrest member (4), disposed at a front side of the seat frame (2) and configured to move between a stowed position and a reclined position relative to the seat frame (2); a driving mechanism (3), comprising a driving bar (31), and two driving arms (32) disposed at two lateral sides of the driving bar (31) and one-to-one corresponding to the two mounting boards (21), wherein each of the driving arms (32) has a guide rod (33) and a pin (34), the guide rod (33) matches with the curved guide slot (22) of a corresponding one of the two mounting boards (21), and the pin (34) is rotatably connected with the corresponding one of the two mounting boards (21); and a footrest linkage mechanism (5), connected to the seat frame (2), the driving mechanism (3) and the footrest member (4); wherein the driving bar (31) is configured to drive the guide rod (33) of each of the two driving arms (32) to correspondingly move between a first position and a second position in the curved guide slot (22) of the corresponding one of the two mounting boards (21). When the guide rod (33) of each of the two driving arms (32) moves to the first position in the curved guide slot (22) of the corresponding one of the two mounting boards (21), the driving mechanism (3) drives the footrest linkage mechanism (5) to move the footrest member (4) to the stowed position, and when the guide rod (33) of each of the two driving arms (32) moves to the second position in the curved guide slot (22) of the corresponding one of the two mounting boards (21), the driving mechanism (3) drives the footrest linkage mechanism (5) to move the footrest member (4) to the reclined position.

In one embodiment, the footrest linkage mechanism (5) includes: a first linkage member (51) fixed to the two driving arms (32), wherein the first linkage member (51) has a first end fixed to the guide rods (33) of the two driving arms (32), a second end, and a middle portion located therebetween and fixed to the pins (34) of the two driving arms (32); a second linkage member (52) having a first end rotatably connected to the second end of the first linkage member (51), a second end, and a middle portion located therebetween; a third linkage member (53) having a first end rotatably connected to the second end of the second linkage member (52), and a second end rotatably connected to the seat frame (2); and a fourth linkage member (54) having a first end rotatably connected to the footrest member (4), and a second end rotatably connected to the middle portion of the second linkage member (52).

In one embodiment, the seat frame (2) further includes a first reinforcing member (23) disposed between the two mounting board (21) to connect and fix the two mounting board (21).

In one embodiment, each of the two linkage seats (7) is connected to a corresponding one of the two mounting boards (21) by two linkage members, allowing the seat frame (2) to move vertically between the upper position and the bottom position relative to the base frame (1) through rotation of the two linkage members.

In one embodiment, the seat frame (2) further includes a second reinforcing member (24) located behind and in parallel to the first reinforcing member (23), and when the seat frame (2) is located at the bottom position, the second reinforcing member (24) is in contact with the two linkage seats (7).

In one embodiment, the lift chair further includes a backrest member (8), disposed at a back side of the seat frame (2) and configured to move between a backrest stowed position and a backrest reclined position relative to the seat frame (2).

In one embodiment, the lift chair is switchable between a first stance, a second stance, a third stance and a fourth stance. In the first stance, the seat frame (2) is in the bottom position, the footrest member (4) is in the stowed position, the backrest member (8) is in the backrest stowed position, and the guide rod (33) of each of the two driving arms (32) is in the first position in the curved guide slot (22) of the corresponding one of the two mounting boards (21); in the second stance, the seat frame (2) is in the upper position, the footrest member (4) is in the stowed position, the backrest member (8) is in the backrest stowed position, and the guide rod (33) of each of the two driving arms (32) is in the first position in the curved guide slot (22) of the corresponding one of the two mounting boards (21); in the third stance, the seat frame (2) is in the bottom position, the footrest member (4) is in the reclined position, the backrest member (8) is in the backrest stowed position, and the guide rod (33) of each of the two driving arms (32) is in the second position in the curved guide slot (22) of the corresponding one of the two mounting boards (21); and in the fourth stance, the seat frame (2) is in the bottom position, the footrest member (4) is in the reclined position, the backrest member (8) is in the backrest reclined position, and the guide rod (33) of each of the two driving arms (32) is in the second position in the curved guide slot (22) of the corresponding one of the two mounting boards (21).

In one embodiment, the footrest member (4) has a footrest extension member (81) located at a front side thereof to support ankles of a user.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
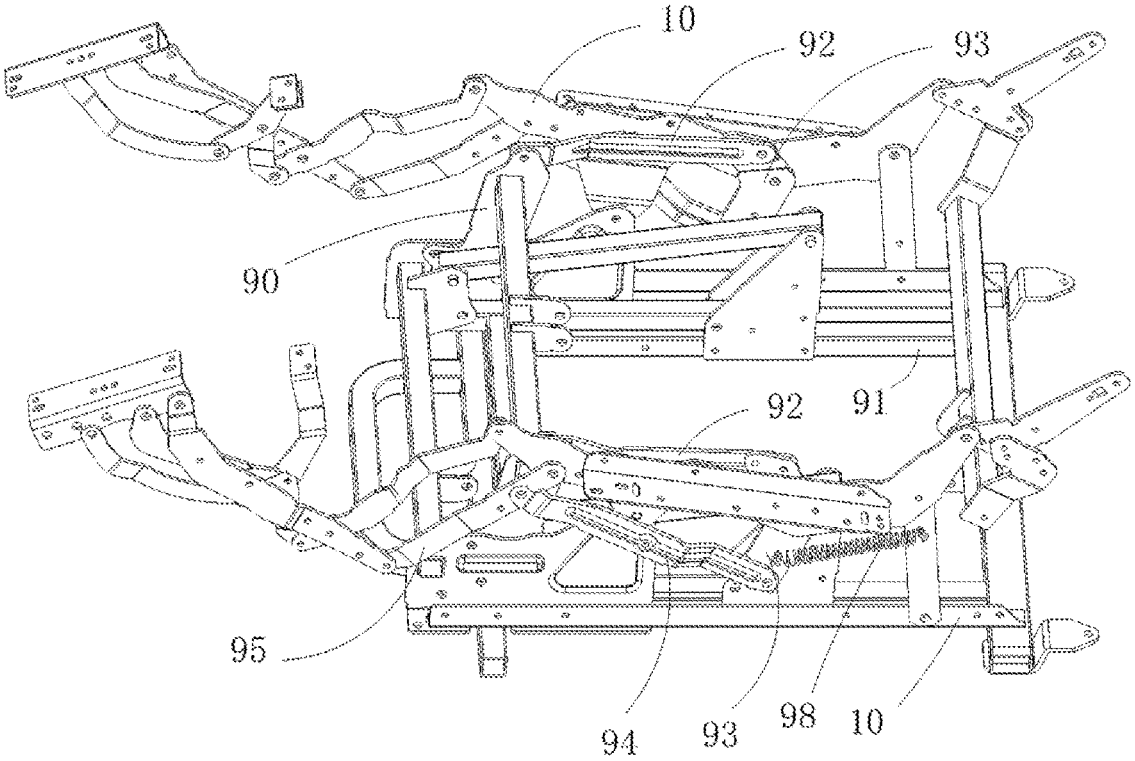
FIG. 1 (Related Art)
FIG. 1 is a schematic view of a conventional lift chair.
Figure 2:
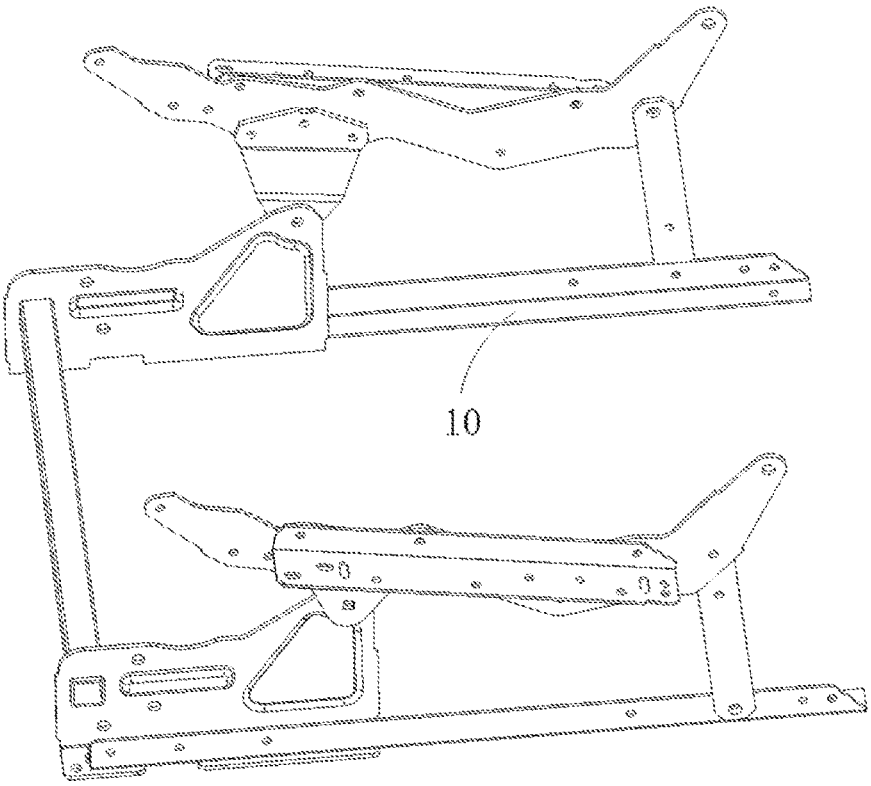
FIG. 2 (Related Art)
FIG. 2 is a schematic view of a seat frame of the conventional lift chair.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

As used herein, "around", "about", "substantially" or "approximately" shall generally mean within 20 percent, preferably within 10 percent, and more preferably within 5 percent of a given value or range. Numerical quantities given herein are approximate, meaning that the term "around", "about" "substantially" or "approximately" can be inferred if not expressly stated.

The description will be made as to the embodiments of the present invention in conjunction with the accompanying drawings. In accordance with the purposes of this invention, as embodied and broadly described herein, this invention, in one aspect, relates to a footrest driving apparatus used in a lift chair.

Figure 3:
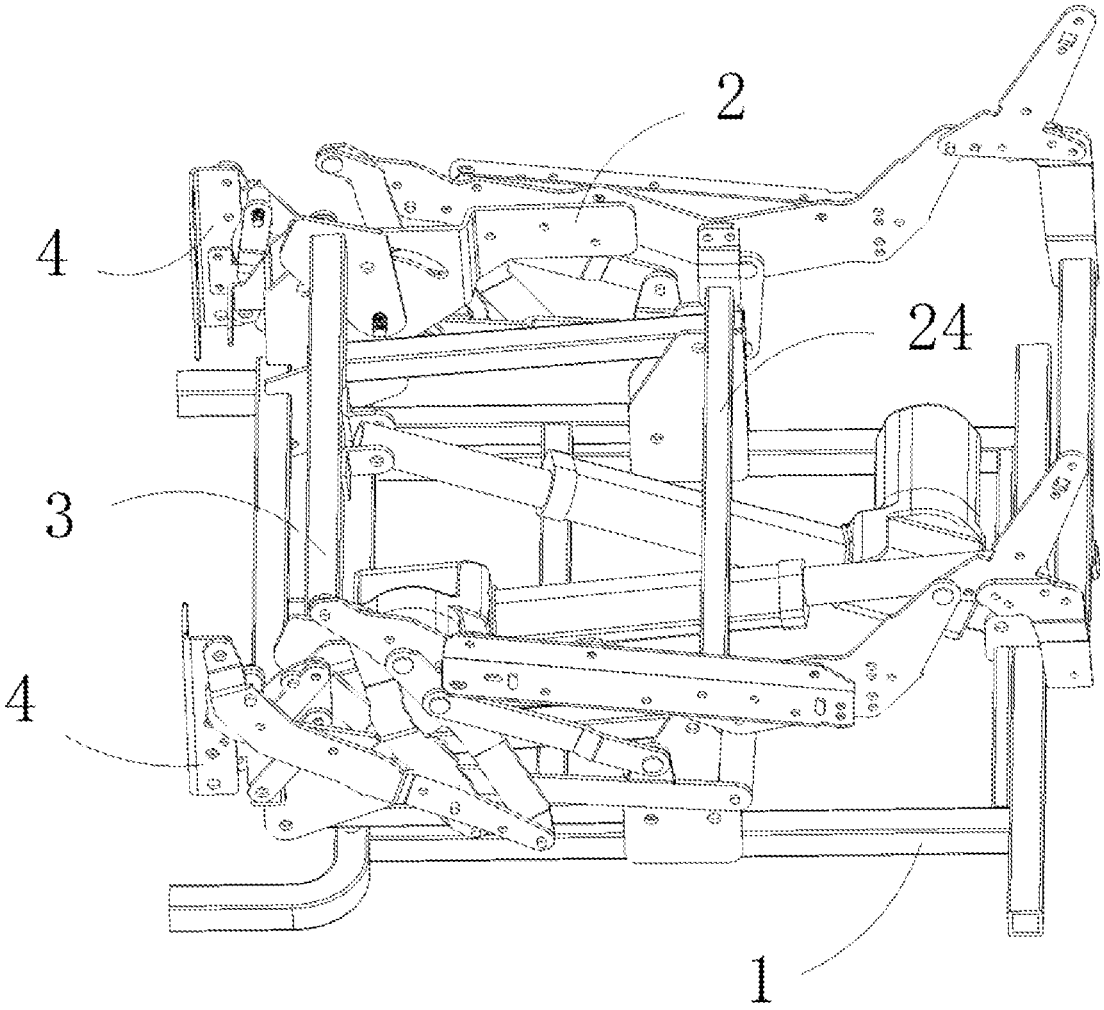
FIG. 3 is a schematic view of a lift chair in a normal stance according to certain embodiments of the present invention.
Figure 4:
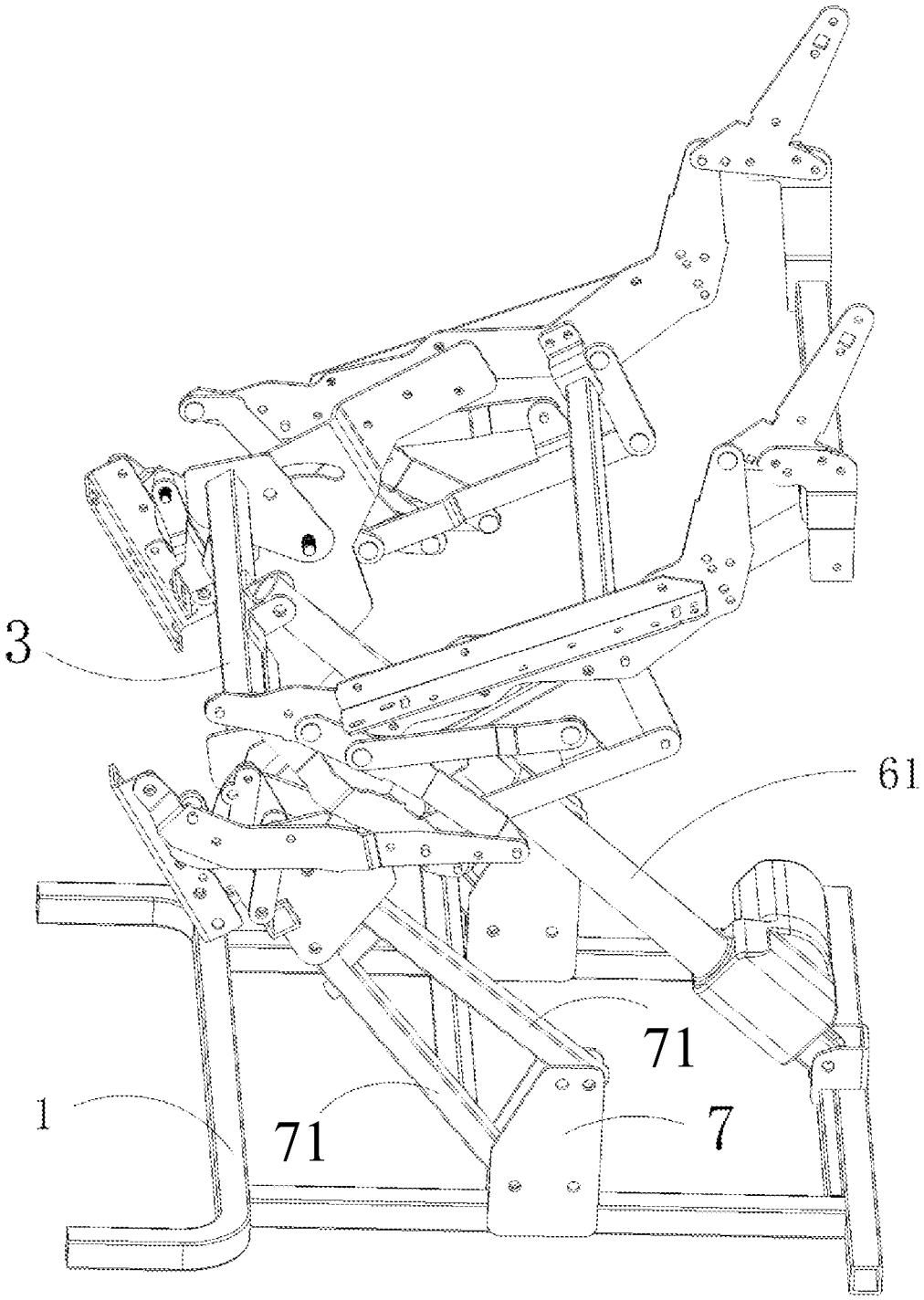
FIG. 4 is a schematic view of the lift chair in an assisting stance according to certain embodiments of the present invention.
Figure 5:
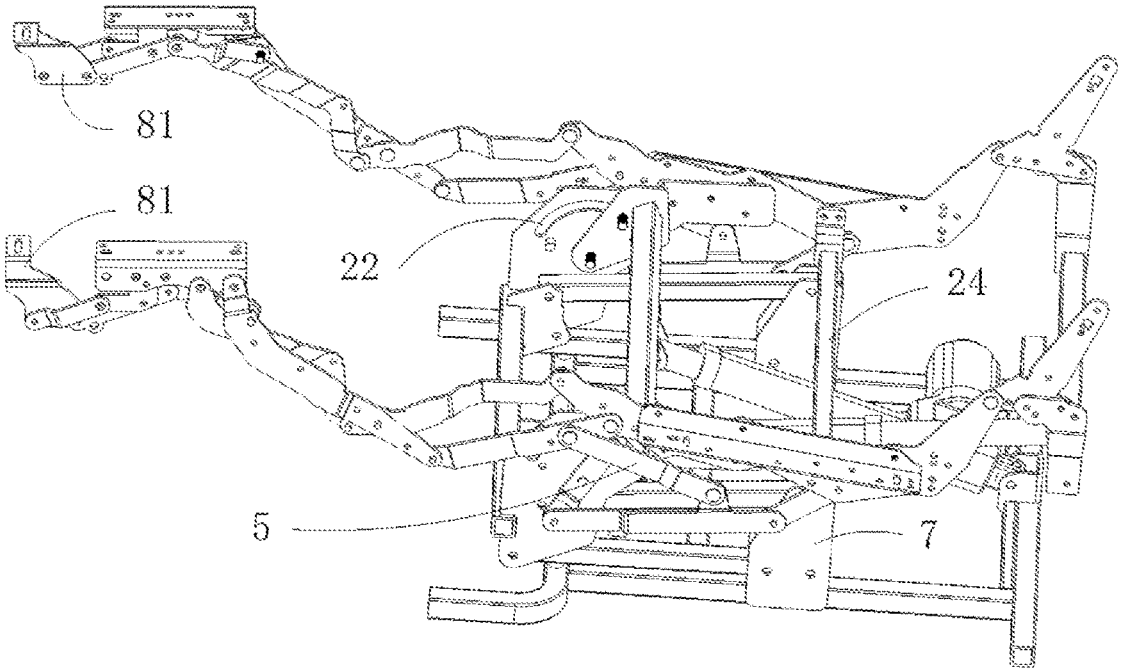
FIG. 5 is a schematic view of the lift chair in a footrest stance according to certain embodiments of the present invention.
Figure 6:
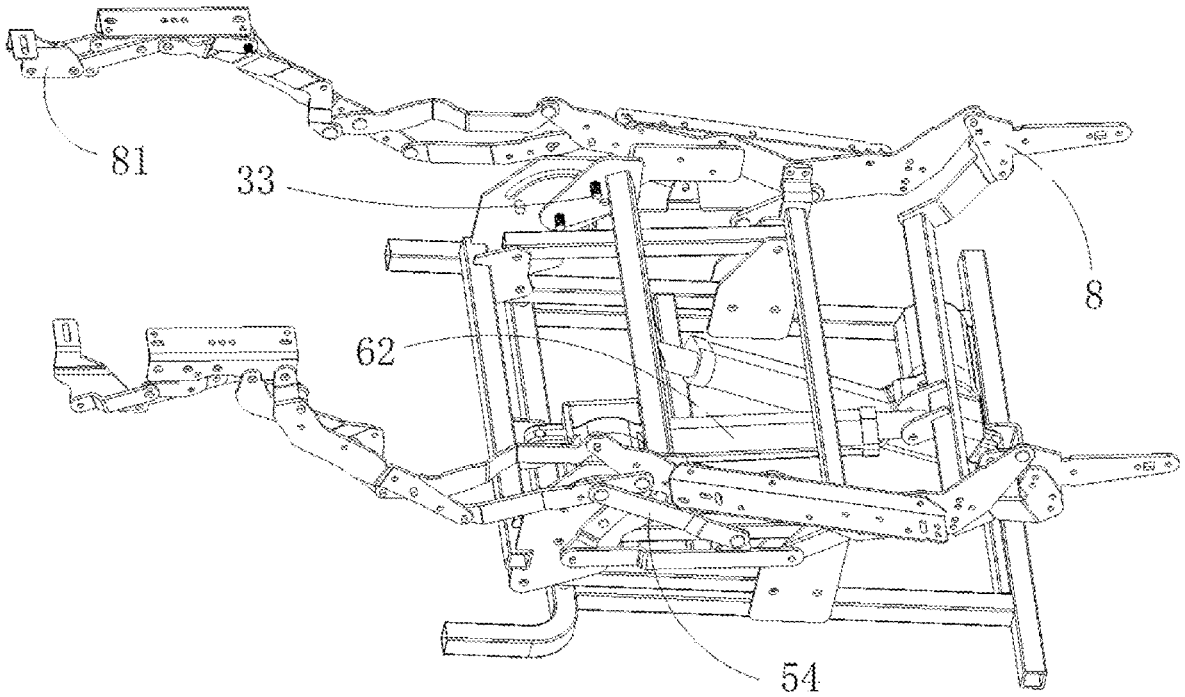
FIG. 6 is a schematic view of a lift chair in a recreational stance according to certain embodiments of the present invention.

Certain aspects of the present invention relates to a footrest driving apparatus used in a lift chair, and the lift chair therewith. For example, FIGS. 3-8 schematically show a lift chair with a footrest driving apparatus according to certain embodiments of the present invention. Specifically, FIG. 3 shows the lift chair in a first stance (which is a normal stance). FIG. 4 shows the lift chair in a second stance (which is an assisting stance). FIG. 5 shows the lift chair in a third stance (which is a footrest stance). FIG. 6 show the lift chair in a fourth stance (which is a recreational stance). The difference stances of the lift chair will be described in detail later.

As shown in FIGS. 3-8, the lift chair includes a base frame (1), a footrest driving apparatus, and a backrest member (8). The footrest driving apparatus includes a seat frame (2), a footrest member (4), a driving mechanism (3) and a footrest linkage mechanism (5) connected to the seat frame (2), the driving mechanism (3) and the footrest member (4). It should be noted that the lift chair and the footrest driving apparatus may include other additional components for assisting and/or limiting the movement or the rotation of each of the components thereof, and details of these additional components are not hereinafter elaborated.

The base frame (1) functions as the base of the lift chair. As shown in FIGS. 4 and 5, the base frame (1) has two linkage seats (7) disposed at two lateral sides thereof. In other words, each of the two lateral sides of the base frame (2) has a corresponding linkage seat (7). Specifically, each of the two linkage seats (7) has two linkage members (71) used for connection with the seat frame (2), allowing the seat frame (2) to move relative to the base frame (1) by the linkage members (71).

The seat frame (2) is disposed above the base frame (1). In one embodiment, a linear driving mechanism (not shown) is provided to drive the seat frame (2) to move relative to the base frame (1) in an obliquely vertical direction, and the linear driving mechanism may be implemented by a linear motor and a corresponding driving cylinder.

Figure 8:
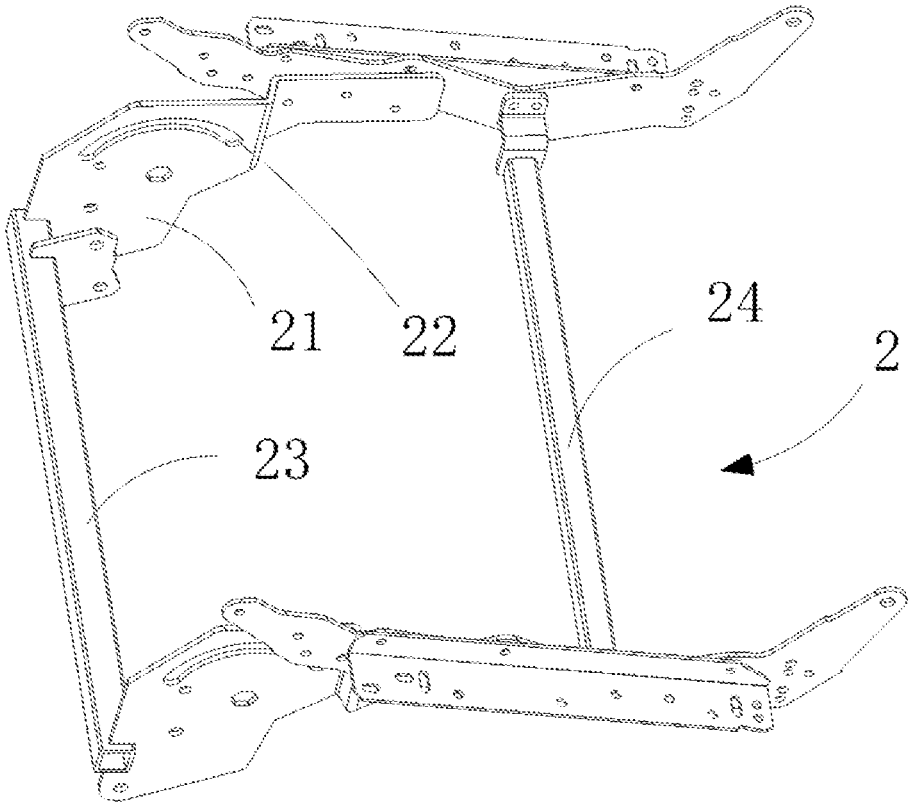
FIG. 8 is a schematic view of the seat frame of the footrest driving apparatus of the lift chair according to certain embodiments of the present invention.

As shown in FIG. 8, the seat frame (2) has two mounting boards (21) disposed at two lateral sides thereof, a first reinforcing member (23) disposed at a front side thereof, and a second reinforcing member (24) disposed at a back side thereof. Each of the two lateral sides of the seat frame (2) has a corresponding mounting board (21). Specifically, the two mounting boards (21) one-to-one corresponding to the two linkage seats (7). In other words, the mounting board (21) and the linkage seat (7) located at the same lateral side correspond to each other. The two linkage members (71) of each linkage seat (7) are connected to the corresponding mounting board (21) to facilitate the movement of the seat frame (2) relative to the base frame (1). The first reinforcing member (23) is disposed between the two mounting board (21) and extends along the lateral direction to connect and fix the two mounting board (21), and the second reinforcing member (24) is located behind and in parallel to the first reinforcing member (23), such that the seat frame (2) forms a stable structure by the first reinforcing member (23) and the second reinforcing member (24). Each of the two mounting boards (21) has a curved guide slot (22) formed thereon.

Figure 7:
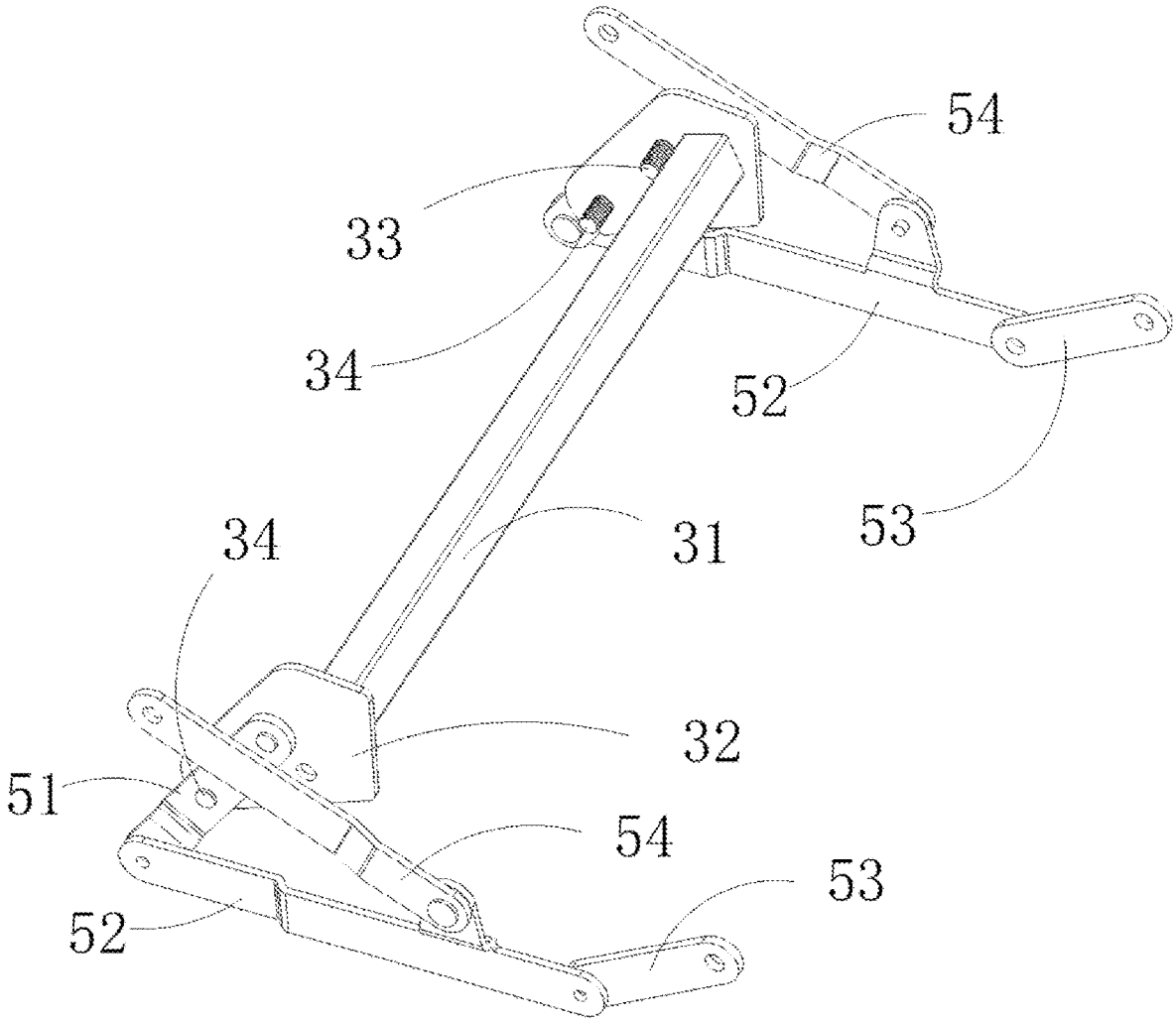
FIG. 7 is a schematic view of the driving mechanism and the footrest linkage mechanism of the footrest driving apparatus of the lift chair according to certain embodiments of the present invention.

The driving mechanism (3) is provided for driving the overall movements of the footrest driving apparatus. As shown in FIG. 7, the driving mechanism (3) includes a driving bar (31) and two driving arms (32) disposed at two lateral sides of the driving bar (31). Each of the two lateral sides of the driving mechanism (3) has a corresponding driving arm (32). Specifically, the two driving arms (32) one-to-one corresponding to the two mounting boards (21). In other words, the driving arm (32) and the mounting board (21) located at the same lateral side correspond to each other. Each of the driving arms (32) has a guide rod (33) and a pin (34). The guide rod (33) matches with the curved guide slot (22) of the corresponding mounting board (21), and the pin (34) is rotatably connected with the corresponding mounting board (21), allowing the driving arm (32) to rotate about the pin (34) and relative to the corresponding mounting board (21) by the matching of the guide rod (33) and the curved guide slot (22). Specifically, a linear driving mechanism formed by a first linear motor (61) and a corresponding driving cylinder is provided on the base frame (1), and the first linear motor (61) may apply a driving force to the driving bar (31) (see FIGS. 3 and 4), which drives the guide rod (33) of each of the two driving arms (32) to correspondingly move between a first position and a second position in the curved guide slot (22) of the corresponding mounting boards (21). In this case, the driving mechanism (3) may move relative to the seat frame (2).

The footrest member (4) is disposed at a front side of the seat frame (2). Specifically, the footrest member (4) is driven by the driving mechanism (3) and the footrest linkage mechanism (5) to be movable between a stowed position and a reclined position relative to the seat frame (2). In certain embodiments, the footrest member (4) has a footrest extension member (81) (see FIG. 5), which is located at a front side of the footrest member (4) to support ankles of a user.

The footrest linkage mechanism (5) is a bar linkage mechanism connected to the seat frame (2), the driving mechanism (3) and the footrest member (4). As shown in FIG. 7, the footrest linkage mechanism (5) is located at the front side of the seat frame (2) and behind the footrest member (4), and includes two sets of four bar linkages located at the two lateral sides of the seat frame (2), where each set of the four bar linkages corresponds to a driving arm (32). Specifically, each set of the four bar linkages is formed by a first linkage member (51), a second linkage member (52), a third linkage member (53) and a fourth linkage member (54). The first linkage member (51) is fixed to the corresponding driving arm (32). Specifically, the first linkage member (51) has a first end fixed to the guide rod (33) of the corresponding driving arm (32), a second end rotatably connected to the first end of the second linkage member (52), and a middle portion located therebetween and fixed to the pin (34) of the corresponding driving arm (32). The second linkage member (52) has a first end rotatably connected to the second end of the first linkage member (51), a second end rotatably connected to the first end of the third linkage member (53), and a middle portion located therebetween. The third linkage member (53) has a first end rotatably connected to the second end of the second linkage member (52), and a second end rotatably connected to the seat frame (2). The fourth linkage member (54) has a first end rotatably connected to the footrest member (4), and a second end rotatably connected to the middle portion of the second linkage member (52).

As described above, the first linkage member (51) is fixed to the corresponding driving arm (32) by the first end being fixed to the guide rod (33) of the corresponding driving arm (32) and the middle portion being fixed to the pin (34) of the corresponding driving arm (32). Thus, when each of the driving arms (32) rotates about the pin (34) and relative to the corresponding mounting board (21) by the matching of the guide rod (33) and the curved guide slot (22), the corresponding first linkage member (51) also rotates about the pin (34), and correspondingly drives the second linkage member (52), the third linkage member (53) and the fourth linkage member (54) to rotate relative to the seat frame (2). In this case, the seat frame (2), the first linkage member (51), the second linkage member (52) and the third linkage member (53) collectively form a four-bar linkage mechanism, and the fourth linkage member (54) is correspondingly driven to rotate by the movement of the four-bar linkage mechanism. Since the first end of the fourth linkage member (54) is rotatably connected to the footrest member (4), the rotation of the fourth linkage member (54) may drive the footrest member (4) to move.

In operation, a user of the lift chair may apply an external force to the driving bar (31) of the driving mechanism (3), which drives the guide rod (33) of each of the two driving arms (32) to correspondingly move between a first position and a second position in the curved guide slot (22) of the corresponding mounting boards (21). In this case, the two driving arms (32) and the corresponding first linkage members (51) all rotates about the pins (34), thus correspondingly drive the footrest linkage mechanism (5) to move the footrest member (4). Specifically, when the guide rod (33) of each of the two driving arms (32) moves to the first position in the curved guide slot (22) of the corresponding mounting board (21), the driving mechanism (3) drives the footrest linkage mechanism (5) to move the footrest member (4) to a stowed position, as shown in FIGS. 3 and 4. When the guide rod (33) of each of the two driving arms (32) moves to the second position in the curved guide slot (22) of the corresponding one of the two mounting boards (21), the driving mechanism (3) drives the footrest linkage mechanism (5) to move the footrest member (4) to a reclined position, as shown in FIGS. 5 and 6.

The backrest member (8) is disposed at a back side of the seat frame (2). Specifically, the backrest member (8) is movable between a backrest stowed position, as shown in FIGS. 3-5, and a backrest reclined position relative to the seat frame (2), as shown in FIG. 6. Specifically, a linear driving mechanism formed by a second linear motor (62) and a corresponding driving cylinder is provided on the first reinforcing member (23) of the seat frame (2) to drive the backrest member (8) to move between the backrest stowed position and the backrest reclined position.

As discussed above, the lift chair is switchable between the first stance (i.e., the normal stance) as shown in FIG. 3, the second stance (i.e., the assisting stance) as shown in FIG. 4, the third stance (i.e., the footrest stance) as shown in FIG. 5, and the fourth stance (i.e., the recreational stance) as shown in FIG. 6. Specifically, when the lift chair is in the first stance (i.e., the normal stance) as shown in FIG. 3, the seat frame (2) is in a bottom position (which is a seating position) relative to the base frame (1). In this case, the second reinforcing member (24) is in contact with the two linkage seats (7). Further, the guide rod (33) of each of the two driving arms (32) is in the first position in the curved guide slot (22) of the corresponding mounting board (21), such that the footrest member (4) is in the stowed position. The backrest member (8) is also in the backrest stowed position. Since the seat frame (2) is in the bottom position (i.e., the seating position), and both the footrest member (4) and the backrest member (8) are stowed, a user may sit on the lift chair in a regular sitting stance.

When the lift chair is in the second stance (i.e., the assisting stance) as shown in FIG. 4, the seat frame (2) moves upward to be in an upper position relative to the base frame (1), where the seat frame (2) is inclined forward to assist the user to stand up from the lift chair. In this case, the second reinforcing member (24) is detached from the two linkage seats (7). Meanwhile, Further, the guide rod (33) of each of the two driving arms (32) remains in the first position in the curved guide slot (22) of the corresponding mounting board (21), and both the footrest member (4) and the backrest member (8) remain stowed.

When the lift chair is in the third stance (i.e., the footrest stance) as shown in FIG. 5, the seat frame (2) is in the bottom position. In this case, the second reinforcing member (24) is in contact with the two linkage seats (7). Further, the driving mechanism (3) is driven by the first linear motor (61) to move, thus correspondingly driving the guide rod (33) of each of the two driving arms (32) to move from the first position to the second position in the curved guide slot (22) of the corresponding mounting board (21). Accordingly, the footrest member (4) is correspondingly driven to move to the reclined position. Meanwhile, the backrest member (8) remains in the backrest stowed position, such that the user may put the legs on the footrest member while the upper body of the user maintains a relatively straight position, allowing the user to watch TV or read a book.

When the lift chair is in the fourth stance (i.e., the recreational stance) as shown in FIG. 6, the seat frame (2) is in the bottom position. In this case, the second reinforcing member (24) is in contact with the two linkage seats (7). Further, the guide rod (33) of each of the two driving arms (32) remains in the second position in the curved guide slot (22) of the corresponding mounting board (21), and the footrest member (4) remains in the reclined position. Moreover, the backrest member (8) is also driven by the second linear motor (62) to extend backward to the backrest reclined position, allowing the user to recline on the extended lift chair in a reclining or half-lying position.

In the lift chair and the footrest driving apparatus according to the embodiments described above, the structures of the driving mechanism (3) and the footrest linkage mechanism (5) have been designed to reduce the loss of force transmission in the movement of the components of the mechanisms, such that the control to the footrest member (4) by the driving mechanism (5) is direct and reliable, and the support for the footrest member (4) in the moving process is stable. Specifically, when the driving mechanism (3) drives the footrest member (4) to move from the stowed position to the reclined position, the force sustained by the footrest member (4) is transmitted to the front side of the seat frame (2) through the first, second and third linkage bars of the footrest linkage mechanism (5), such that the footrest member (4) stably supports the legs of the user. Further, when the driving mechanism (3) drives the footrest member (4) to move back to the stowed position from the reclined position, the rotation force of the driving mechanism (3) may directly transmit to the footrest member (4), such that the moving of the footrest member (4) is rapid. Moreover, the structure of the seat frame (4) is also modified to reduce the overall weight of the lift chair.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A footrest driving apparatus used in a lift chair, comprising:

a seat frame (2), having two mounting boards (21) disposed at two lateral sides thereof, wherein the two mounting boards (21) are fixed to each other, and each of the two mounting boards (21) has a curved guide slot (22) formed thereon;

a footrest member (4), disposed at a front side of the seat frame (2) and configured to move between a stowed position and a reclined position relative to the seat frame (2);

a driving mechanism (3), comprising a driving bar (31), and two driving arms (32) disposed at two lateral sides of the driving bar (31) and one-to-one corresponding to the two mounting boards (21), wherein each of the driving arms (32) has a guide rod (33) and a pin (34), the guide rod (33) matches with the curved guide slot (22) of a corresponding one of the two mounting boards (21), and the pin (34) is rotatably connected with the corresponding one of the two mounting boards (21); and a footrest linkage mechanism (5), connected to the seat frame (2), the driving mechanism (3) and the footrest member (4);

wherein the driving bar (31) is configured to drive the guide rod (33) of each of the two driving arms (32) to correspondingly move between a first position and a second position in the curved guide slot (22) of the corresponding one of the two mounting boards (21); and wherein when the guide rod (33) of each of the two driving arms (32) moves to the first position in the curved guide slot (22) of the corresponding one of the two mounting boards (21), the driving mechanism (3) drives the footrest linkage mechanism (5) to move the footrest member (4) to the stowed position, and when the guide rod (33) of each of the two driving arms (32) moves to the second position in the curved guide slot (22) of the corresponding one of the two mounting hoards (21), the driving mechanism (3) drives the footrest linkage mechanism (5) to move the footrest member (4) to the reclined position.

2. The footrest driving apparatus according to claim 1, wherein the footrest linkage mechanism (5) comprises:

a first linkage member (51) fixed to the two driving arms (32), wherein the first linkage member (51) has a first end fixed to the guide rods (33) of the two driving arms (32), a second end, and a middle portion located therebetween and fixed to the pins (34) of the two driving arms (32);

a second linkage member (52) having a first end rotatably connected to the second end of the first linkage member (51), a second end, and a middle portion located therebetween;

a third linkage member (53) having a first end rotatably connected to the second end of the second linkage member (52), and a second end rotatably connected to the seat frame (2); and a fourth linkage member (54) having a first end rotatably connected to the footrest member (4), and a second end rotatably connected to the middle portion of the second linkage member (52).

3. The footrest driving apparatus according to claim 1, wherein the seat frame (2) further comprises a first reinforcing member (23) disposed between the two mounting boards (21) to connect and fix the two mounting boards (21).

4. The footrest driving apparatus according to claim 3, wherein the lift chair has a base frame (1) having two linkage seats (7) disposed at two lateral sides thereof and one-to-one corresponding to the two mounting boards (21), each of the two linkage seats (7) is connected to a corresponding one of the two mounting boards (21) by two linkage members, allowing the seat frame (2) to move vertically between an upper position and a bottom position relative to the base frame (1) through rotation of the two linkage members.

5. The footrest driving apparatus according to claim 4, wherein the seat frame (2) further comprises a second reinforcing member (24) located behind and in parallel to the first reinforcing member (23), and when the seat frame (2) is located at the bottom position, the second reinforcing member (24) is in contact with the two linkage seats (7).

6. The footrest driving apparatus according to claim 1, wherein the footrest member (4) has a footrest extension member (81) located at a front side thereof to support ankles of a user.

7. A lift chair, comprising:

a base frame (1) having two linkage seats (7) disposed at two lateral sides thereof; and a footrest driving apparatus, comprising:

a seat frame (2), disposed above the base frame (1), having two mounting boards (21) disposed at two lateral sides thereof and one-to-one corresponding to the two linkage seats (7), wherein the seat frame (2) is configured to move vertically between an upper position and a bottom position relative to the base frame (1), the two mounting boards (21) are fixed to each other, and each of the two mounting boards (21) has a curved guide slot (22) formed thereon;

a footrest member (4), disposed at a front side of the seat frame (2) and configured to move between a stowed position and a reclined position relative to the seat frame (2);

a driving mechanism (3), comprising a driving bar (31), and two driving arms (32) disposed at two lateral sides of the driving bar (31) and one-to-one corresponding to the two mounting boards (21), wherein each of the driving arms (32) has a guide rod (33)

and a pin (34), the guide rod (33) matches with the curved guide slot (22) of a corresponding one of the two mounting boards (21), and the pin (34) is rotatably connected with the corresponding one of the two mounting boards (21); and a footrest linkage mechanism (5), connected to the seat frame (2), the driving mechanism (3) and the footrest member (4);

wherein the driving bar (31) is configured to drive the guide rod (33) of each of the two driving arms (32) to correspondingly move between a first position and a second position in the curved guide slot (22) of the corresponding one of the two mounting boards (21); and wherein when the guide rod (33) of each of the two driving arms (32) moves to the first position in the curved guide slot (22) of the corresponding one of the two mounting boards (21), the driving mechanism (3) drives the footrest linkage mechanism (5) to move the footrest member (4) to the stowed position, and when the guide rod (33) of each of the two driving arms (32) moves to the second position in the curved guide slot (22) of the corresponding one of the two mounting boards (21), the driving mechanism (3) drives the footrest linkage mechanism (5) to move the footrest member (4) to the reclined position.

8. The lift chair according to claim 7, wherein the footrest linkage mechanism (5) comprises:

a first linkage member (51) fixed to the two driving arms (32), wherein the first linkage member (51) has a first end fixed to the guide rods (33) of the two driving arms (32), a second end, and a middle portion located therebetween and fixed to the pins (34) of the two driving arms (32);

a second linkage member (52) having a first end rotatably connected to the second end of the first linkage member (51), a second end, and a middle portion located therebetween;

a third linkage member (53) having a first end rotatably connected to the second end of the second linkage member (52), and a second end rotatably connected to the seat frame (2); and a fourth linkage member (54) having a first end rotatably connected to the footrest member (4), and a second end rotatably connected to the middle portion of the second linkage member (52).

9. The lift chair according to claim 7, wherein the seat frame (2) further comprises a first reinforcing member (23) disposed between the two mounting boards (21) to connect and fix the two mounting boards (21).

10. The lift chair according to claim 9, wherein each of the two linkage seats (7) is connected to a corresponding one of the two mounting boards (21) by two linkage members, allowing the seat frame (2) to move vertically between the upper position and the bottom position relative to the base frame (1) through rotation of the two linkage members.

11. The lift chair according to claim 9, wherein the seat frame (2) further comprises a second reinforcing member (24) located behind and in parallel to the first reinforcing member (23), and when the seat frame (2) is located at the bottom position, the second reinforcing member (24) is in contact with the two linkage seats (7).

12. The lift chair according to claim 7, further comprising a backrest member (8), disposed at a back side of the seat frame (2) and configured to move between a backrest stowed position and a backrest reclined position relative to the seat frame (2).

13. The lift chair according to claim 12, being switchable between a first stance, a second stance, a third stance and a fourth stance, wherein:

in the first stance, the seat frame (2) is in the bottom position, the footrest member (4) is in the stowed position, the backrest member (8) is in the backrest stowed position, and the guide rod (33) of each of the two driving arms (32) is in the first position in the curved guide slot (22) of the corresponding one of the two mounting boards (21);

in the second stance, the seat frame (2) is in the upper position, the footrest member (4) is in the stowed position, the backrest member (8) is in the backrest stowed position, and the guide rod (33) of each of the two driving arms (32) is in the first position in the curved guide slot (22) of the corresponding one of the two mounting boards (21);

in the third stance, the seat frame (2) is in the bottom position, the footrest member (4) is in the reclined position, the backrest member (8) is in the backrest stowed position, and the guide rod (33) of each of the two driving arms (32) is in the second position in the curved guide slot (22) of the corresponding one of the two mounting boards (21); and in the fourth stance, the seat frame (2) is in the bottom position, the footrest member (4) is in the reclined position, the backrest member (8) is in the backrest reclined position, and the guide rod (33) of each of the two driving arms (32) is in the second position in the curved guide slot (22) of the corresponding one of the two mounting boards (21).

14. The lift chair according to claim 7, wherein the footrest member (4) has a footrest extension member (81) located at a front side thereof to support ankles of a user.

* * * * *